US005441067A

United States Patent [19]

James et al.

[11] Patent Number: 5,441,067

[45] Date of Patent: Aug. 15, 1995

[54] SUN SHADE FOR OUTDOOR FURNITURE

[75] Inventors: Peter James; Bart Boelryk, both of Orillia, Canada

[73] Assignee: Solar-Wise Products Inc., Orillia, Canada

[21] Appl. No.: 189,554

[22] Filed: Feb. 1, 1994

[51] Int. Cl.[6] ..... E04H 15/02

[52] U.S. Cl. ..... 135/96; 135/128; 135/161; 297/184.15

[58] Field of Search ..... 135/90, 96, 128, 156, 135/157, 161, 114, 20.1, 19.1, 16; 297/184.1, 184.11, 184.13, 184.15

[56] References Cited

U.S. PATENT DOCUMENTS 2,618,285 11/1952 Heisig ..... 135/90
3,738,703 6/1973 Kunimatu .
4,030,748 6/1977 Brock .
4,093,305 6/1978 Staroste et al. .
4,201,416 5/1980 Vanderminden .
4,230,363 10/1980 Borichevsky .
4,293,162 10/1981 Pap et al. .
4,300,798 11/1981 Musgrove et al. .
4,639,036 1/1987 Nichols .
4,858,990 8/1989 Combs-Rose et al. .
4,865,381 9/1989 Van Rogue .
5,013,085 5/1991 Craig .
5,096,257 3/1992 Clark .

*Primary Examiner*—Lanna Mai

[57] ABSTRACT

The present invention provides for a sun shade arrangement for attachment to outdoor furniture. The arrangement includes a reusable clamping means, an arm having a forward end and a sun shade member having a mounting end piece releasably secured to the forward end of the arm. The arm includes spaced apart bars removably and adjustably secured to the clamping means. The spaced apart bars are connected to one another at the forward end of the arm and provide a releasable connection for the mounting end piece of the sun shade member.

16 Claims, 4 Drawing Sheets

FIG. 1.
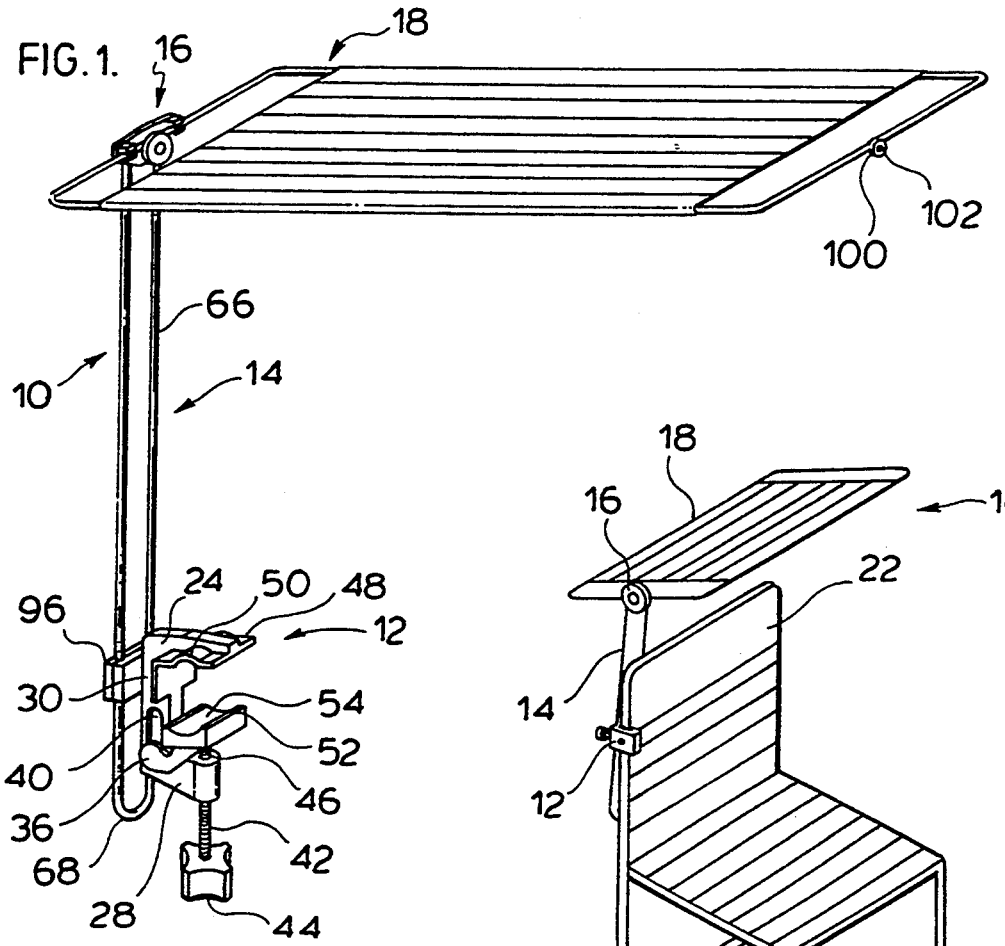
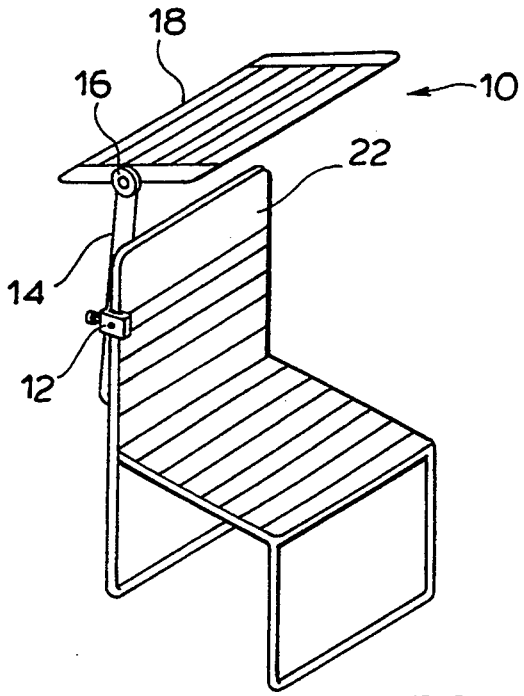
FIG. 3.
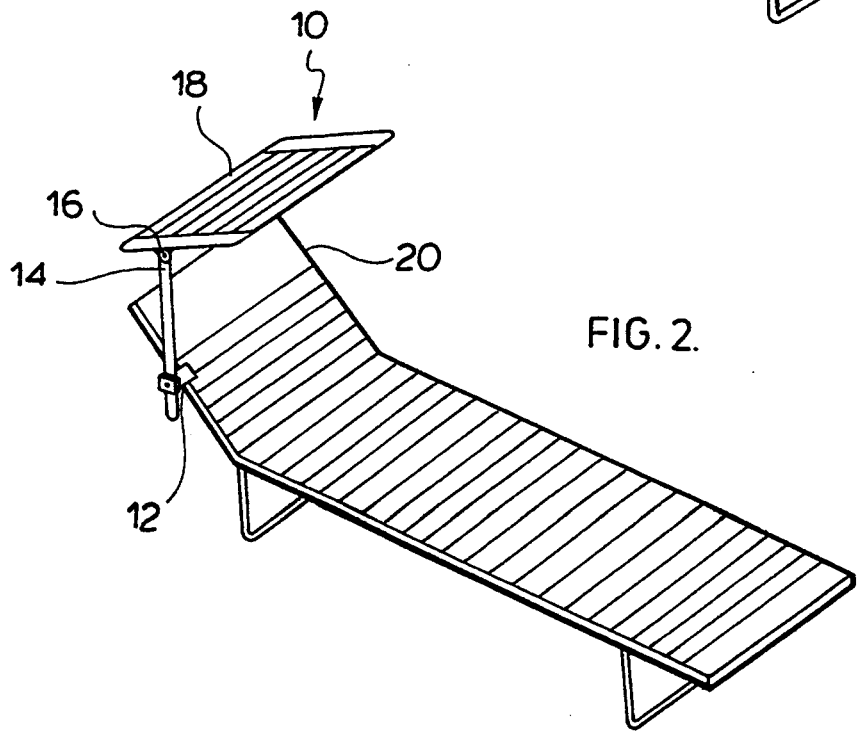
FIG. 2.

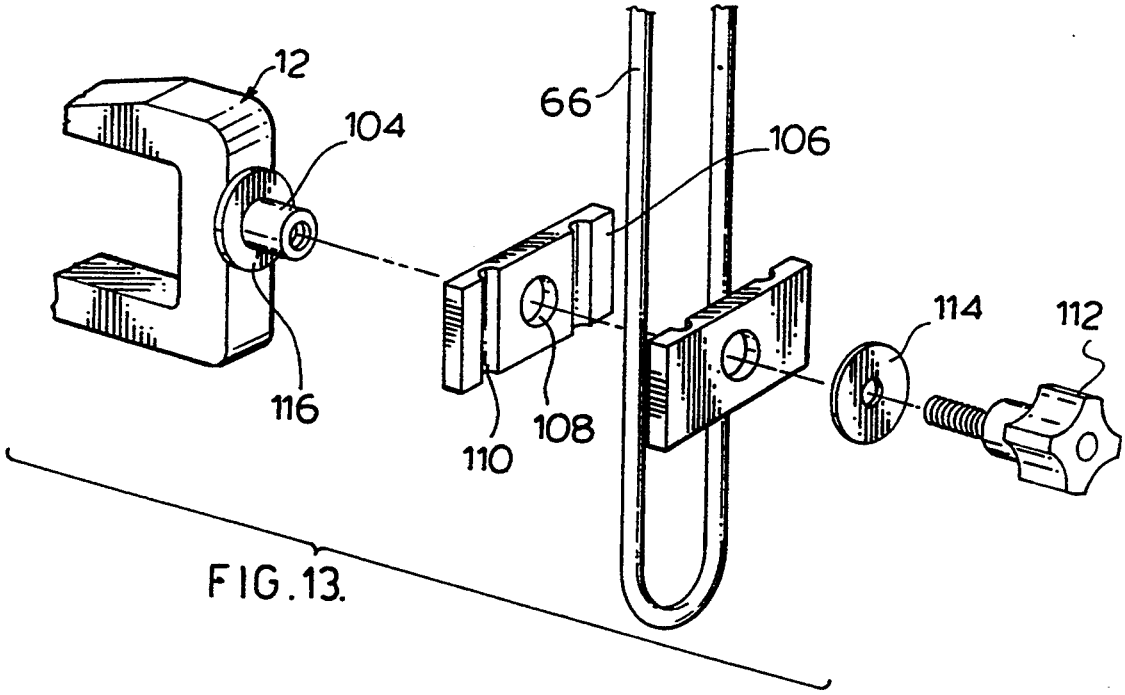
FIG. 13.
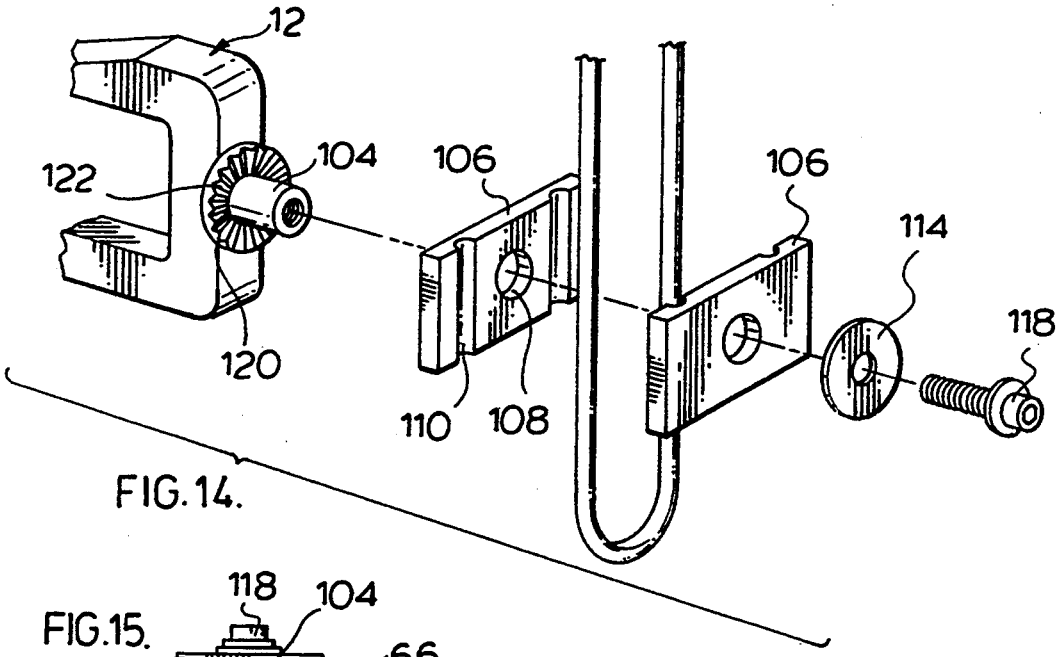
FIG. 14.
FIG. 15.
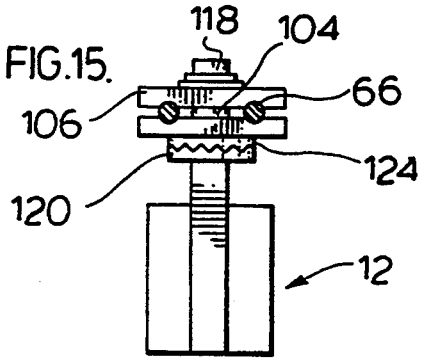

SUN SHADE FOR OUTDOOR FURNITURE

FIELD OF THE INVENTION

The present invention relates to a sun shade for releasable attachment to outdoor furniture. In particular, the invention relates to a sun shade having a wide range of adjustability for releasable attachment to lawn chairs and other such outdoor furniture.

BACKGROUND OF THE INVENTION

With the increased emphasis on the harmful affects of prolonged exposure to UV radiation from the sun, many products have been developed for providing shading particularly for the face and head region of persons sitting or reclining in outdoor furniture.

U.S. Pat. No. 4,030,748 describes a sun shade for use on a lounge chair which is a piece of flexible plastic of a length greater than the width of the chair attached to clamping brackets clamped onto the sides of the chair such that the sheet may be pivoted to many different positions.

U.S. Pat. No. 5,096,257 is directed to an easily assembled, dismantled and transported sun shade having a U-shaped rigid frame supporting a fabric cover and two support arms attachable to a chair with common clamps. The supporting structure for the sun shade is easily dismountable and is also adjustable for length of the sun shade portion, height of the sun shade from the chair and angle of the sun shade portion.

U.S. Pat. No. 5,013,085 describes a sun shade canopy for attachment to a tubular chair having an adjustable clamping mechanism for attachment to the chair which utilizes mating serrated pieces and a spring bias such that the mated pieces may be pulled away from one another against the biasing of the spring, the canopy rotated to a desired position and then the spring biases the mating serrated surfaces together to securely hold the canopy in the desired position. The canopy is permanently attached to the vertical support rod and the vertical support rods are in turn permanently attached to the clamping mechanism.

U.S. Pat. No. 4,865,381 describes a canopy for attachment to, for example, a lawn chair having means for adjustment of the angle of the canopy separate from the means for clamping the canopy directly to the lounge chair. The frame includes two U-shaped members, one for clamping to the lounge chair and another for supporting the canopy, and side arms pivotally mounted between the two U-shaped members.

U.S. Pat. No. 4,858,990 describes a sun shade for attachment to an infant chair and, in particular, the clamp which is used to attach the shade to the chair, the clamp having a recess for receiving the head of a bolt and holding the bolt in position so that a wing nut may be tightened down to clamp the apparatus to the chair. The patent also describes that the shade has adjustments using mated serrated surfaces for adjustment of the angle of the sun shade.

U.S. Pat. No. 4,201,416 describes a canopy for outdoor chairs and, in particular, a clamp for clamping the canopy such that the canopy could not fall down on top of the user. The clamp has a stop against which the extending arm of the canopy rests to prevent the canopy from falling further forward.

U.S. Pat. No. 4,230,363 describes a similar type canopy but has a different clamping means which is adapted to fit over a stiffening rod extending between the uprights of the chair back. As a result of the structure of the clamp the side supports for the canopy are in direct alignment with the tubular frame of the chair. The canopy therefore cannot be folded completely over the back of the chair.

U.S. Pat. No. 4,293,162 describes a sun shade for use with an infant's seat, the sun shade being attached to the infant's seat through a clamp attached to the back of the infant's seat. The sun shade provides for multiple angular adjustment of the sun shade through the provision of vertical adjustment of the vertical support through the clamp which attaches the shade to the back of the chair, angular adjustment between the horizontal and vertical supports and a ball and socket arrangement at the end of the horizontal support for attachment to the sun shade frame. The sun shade frame can slide back and forth on the ball and socket assembly and the ball and socket assembly provides for an infinite variety of pivoting adjustments.

U.S. Pat. No. 4,093,305 describes a sun shade for attachment to the back of a chair where the sun shade frame may be folded down with the chair. The sun shade frame has three U-shaped members which are attached to a clamp for clamping to the side of the chair by means of a bolt arrangement. These three U-shaped members may be spread apart to extend the sun shade in its shielding position.

U.S. Pat. No. 4,639,036 describes a sun shade which is easily attachable to the chair through a biased clamp either a biased roller arrangement where the rollers ride over the tubular section of the chair and then hold the tubular section between rollers and the base plate or a spring biased jaw clamp where the clamp has two side engaging members which are spring biased spread apart and then allowed to engage the sides of the tubular member with the spring biasing holds the two members together.

U.S. Pat. No. 4,300,798 describes a sun shade for attachment to a chair using a rather complicated clamping arrangement and providing for some adjustment up and down by means of the vertical post and can be flipped over to be out of the way.

U.S. Pat. No. 3,738,703 describes a sun shade which is easily mountable and demountable on the backrest of a foldable chair as the sun shade frame has an opening which simply rests over the top of the back of the chair.

SUMMARY OF THE INVENTION

The present invention provides for a sun shade arrangement for attachment to outdoor furniture. The arrangement comprises a reusable clamping means, an arm having a forward end and a sun shade member having a mounting end piece releasably secured to the forward end of the arm. The arm comprises spaced apart bars removably and adjustably secured to the clamping means. The spaced apart bars are connected to one another at the forward end of the arm and provide a releasable connection for the mounting end piece of the sun shade member.

BRIEF DESCRIPTION OF THE DRAWINGS

The above as well as other advantages and features of the present invention will be described in greater detail according to a preferred embodiment of the present invention in which:

FIG. 1 is a perspective view of a preferred embodiment of the sun shade according to the present invention;

FIG. 2 is a perspective view of the sun shade of FIG. 1 attached to a chaise lounge;

FIG. 3 is a perspective view of the sun shade of FIG. 1 attached to a lawn chair;

FIG. 13 is an illustration of one means of attachment of the arm to the clamping means;

FIG. 14 is an illustration of a second means of attachment of the arm to the clamping means, and;

FIG. 15 is a top view partly in cross-section of the means of FIG. 14.

DETAILED DESCRIPTION OF THE PREFERRED EMBODIMENTS

Figure 4:
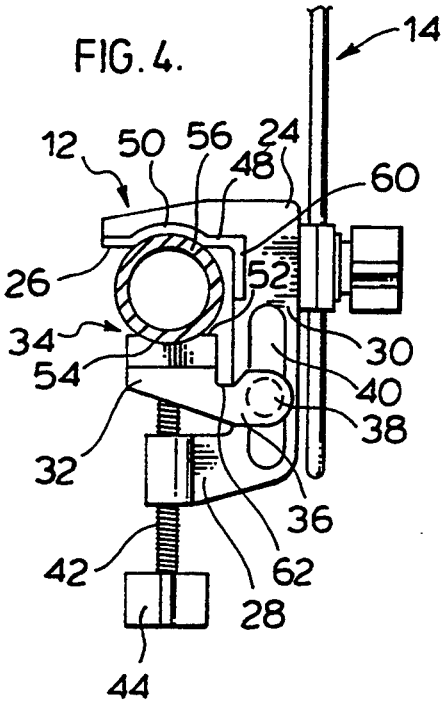
FIG. 4 is a side elevation view of the clamping means of the sun shade of FIG. 1 attached to a tubular member.

The preferred embodiment of the present invention is illustrated in FIG. 1. The sun shade 10 has a clamping means 12 for attachment to a supporting surface. Attached to the clamping means 12 is an arm 14 which is releasably attached at a forward end thereof to a mounting end piece 16. Also attached to the mounting end piece 16 is a sun shade member 18.

FIG. 2 illustrates the sun shade 10 attached to a chaise lounge 20 by clamping the clamping member 12 onto the side of the chaise lounge 20. FIG. 3 illustrates the sun shade 10 attached to a chair 22 by clamping the clamping member 12 onto the side of the chair 22. It will be appreciated that although the illustrations in FIGS. 2 and 3 show the sun shade 10 attached to the side of the chaise lounge 20 or chair 22, due to the adjustability of the clamping means 12 and sun shade member 18 in relation to the arm 14 as will be described below, the sunshade may be clamped onto other portions of the chaise lounge 20 or chair 22, such as for example the back. In this way the possible positioning of the sun shade 10 may be increased to provide for shielding from the sun no matter in which direction the sun is located relative to the chair or chaise lounge and the person seated therein. The sun shade member 18 may also be made relatively small but still provide adequate shading.

Details of the clamping means 12 are illustrated further in FIGS. 4 through 7. The clamping means 12 has a first clamping member 24 having an upper clamping region 26, a lower screw holding region 28 and a side region 30 connecting the upper clamping region 26 to the lower screw holding region 28. Clamping means 12 is also provided with a second clamping member 32 having a lower clamping region 34. Second clamping member 32 has an extending arm 36 having an engagement member 38 which rides in an adjustment slot 40 provided in the side member 30 of the first clamping member 24. Slot 40 may be such that it extends completely through the side member 30 or it may be grooves provided on either side of the side member in which case the extending arm 36 will be provided with two engagement members 38 to ride in the grooves of the side member 30.

An adjusting screw 42 is provided for the clamping means 12 having a turning knob 44 at one end thereof. The shank of the adjusting screw 42 goes through a threaded hole 46 provided in the lower screw holding region 28. The other end of the adjusting screw is in contact with the second clamping member 32 and when the adjusting screw 42 is turned, it adjusts the clamping space provided between the upper clamping region 26 and lower clamping region 34.

In order to accommodate various shapes of objects to which the clamping means 12 may be attached, the upper clamping region 26 is provided with flat clamping surfaces 48 located on either side of an arched clamping surface 50. Similarly, the lower clamping region 34 is provided with flat clamping surfaces 52 on either side of an arched clamping surface 54. Thus, in FIG. 4, when the object to which the clamping means is attached is a tubular member 56, the tubular member is securely held between the arched clamping surfaces 50 and 54 of the upper clamping region 26 and lower clamping region 34 respectively.

Figure 5:
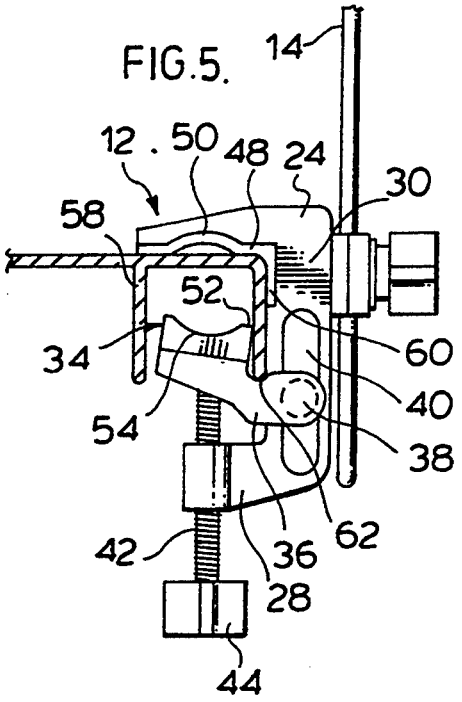
FIG. 5 is a side elevation view of the clamping means attached to a channel member.

FIG. 5 illustrates the clamping means 12 attached to a channel member 58. The channel member 58 is contained within the clamping space of the clamping means 12 through contact with the flat clamping surfaces 48 of the upper clamping region 26. A further clamping surface 60 on the side member 30 engages the side of the channel member 58. The lower end of one of the arms of the channel member 58 is contained within a pocket or groove 62 provided in the extending arm 36 of the second clamping member 32. As the adjusting screw 42 is rotated to tighten the second clamping member 32 onto the channel member 58, the leg of the channel member 58 engages the groove 62 of extending arm 36 and causes the second clamping member 32 to rotate about this point of contact until the top edge of the flat clamping surface 52 of the lower clamping region 34 comes into contact with the inner surface of the leg of the channel member 58. In this way the channel member 58 is securely held by the clamping means 12 through numerous points of contact between the clamping means 12 and the exterior surfaces and the interior surfaces of the channel member 58.

Figure 6:
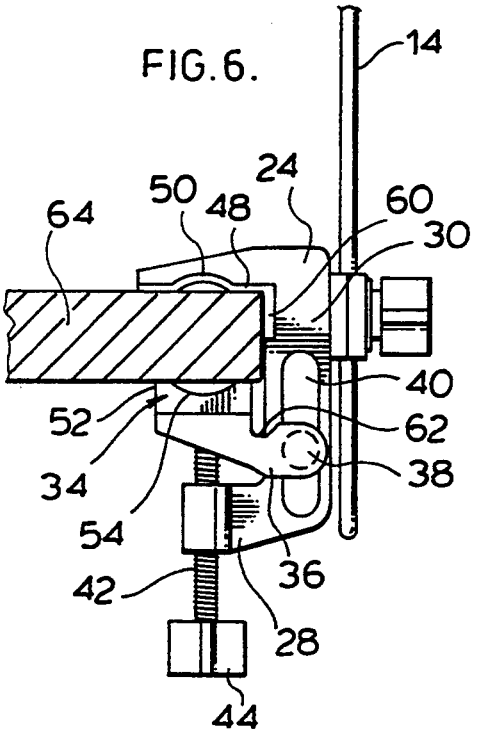
FIG. 6 is a side elevation view of the clamping means attached to a table top.
Figure 7:
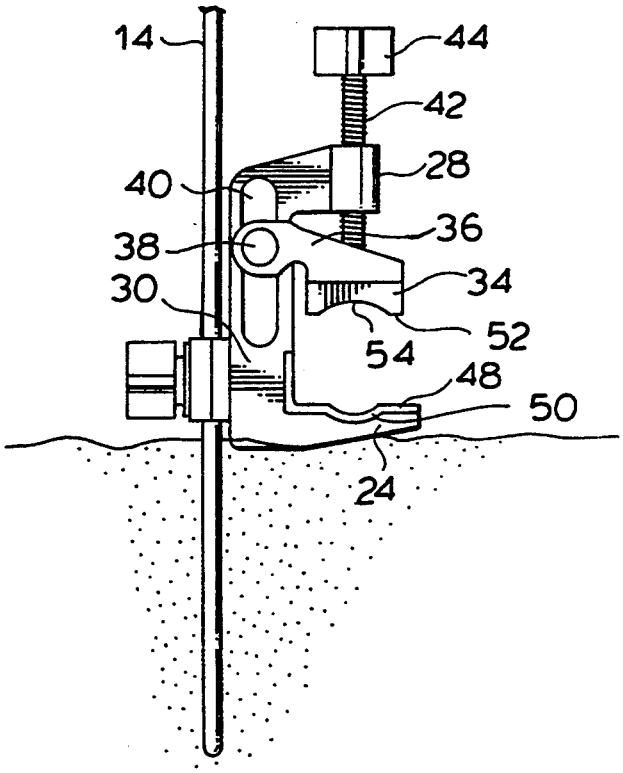
FIG. 7 is a side elevation view of the sun shade supported on the ground.
Figure 8:
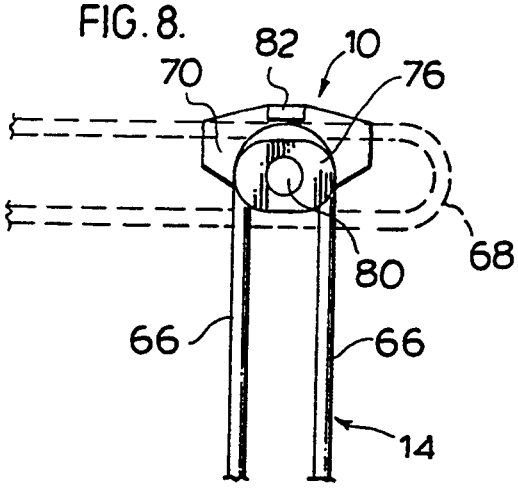
FIG. 8 is a front view illustrating the means of attachment of the arm to the sun shade member.
Figure 9:
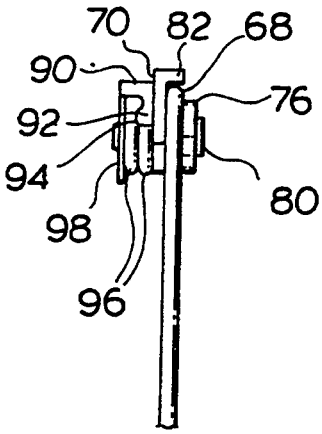
FIG. 9 is a side elevation view of the mounting end piece for attachment of the arm and the sun shade member.
Figure 10:
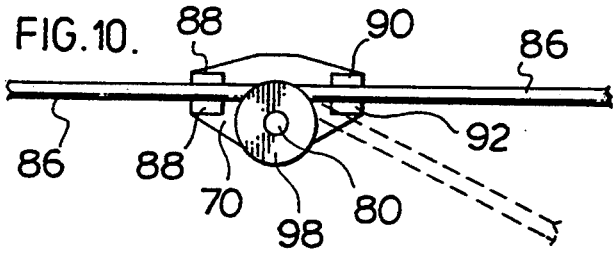
FIG. 10 is a rear view of the mounting end piece for the sun shade member illustrating the collapsibility of the sun shade member.
Figure 11:
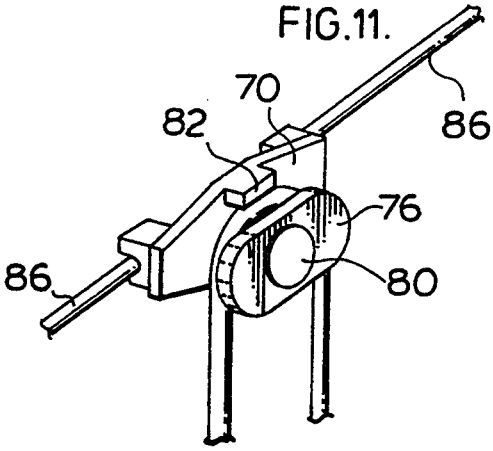
FIG. 11 is a front perspective view of the mounting end piece for the sun shade member.
Figure 12:
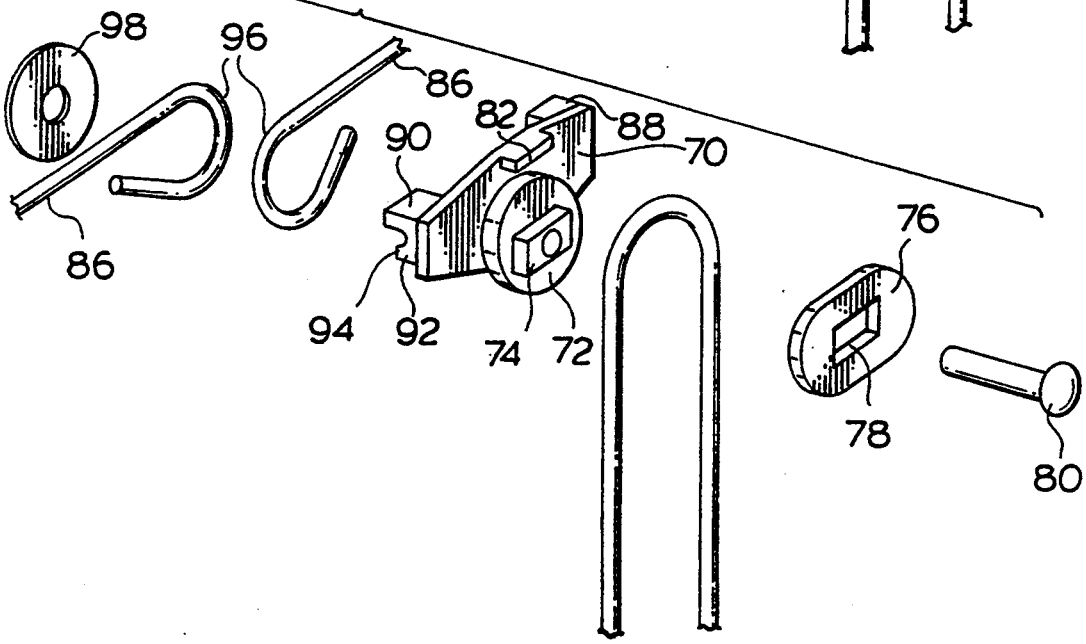
FIG. 12 is an exploded front perspective view of the mounting end piece for the sun shade member.

As illustrated in FIG. 6, when the clamping means 12 is attached to a planar surface such as a table top 64, the table top 64 is securely held by the clamping means through contact with the flat clamping surfaces 48, 52 and 60 located on the upper clamping region 26, lower clamping region 34 and side member 30 respectively.

In those situations where there is no surface available on which to attach the clamping means 12 such as, for example, if the person is laying on the ground, the sun shade may be used by rotating the arm 14 about the clamping means 12 as will be described further herein below and extending the lower end of the arm 14 to provide for a portion of the arm 14 which may be buried in the ground until the clamping means 12 comes into contact with the ground. In this way the sun shade 10 may be secured in position to provide shade to a reclining user. To increase the stability of the sun shade 10 used in this manner, an object such as a shoe, book, stick, etc. may be clamped in the clamping means 12 to provide a supporting surface in contact with the sand. The clamping means 12 may also be rotated until the side of the clamping means 12 is in contact with the sand rather than the top as illustrated in the figure. In this way the area of contact between the sand and the clamping means is increased resulting in increased stability of the sun shade 10.

As will be appreciated, as a result of the flexibility of the clamping means 12 in its ability to utilize many different shapes and sizes of supporting surfaces, the sun shade 10 of the present invention may be used for attachment to many other objects in addition to outdoor furniture. It may be used with baby strollers, carriages or car seats to shield infants from the sun. It may also be used on boats by attachment to the gunwale or handrail of the boat to shield the occupants from the sun. The sun shade 10 of the present invention may be used in any situation where it can be clamped or attached to a supporting surface to provide shade from the sun. The clamping means may also have utility in other situations where it is desired to attach an object other than the sun shade to a supporting surface as the structure of the clamping means allows for flexibility in use on many different supporting surfaces.

FIGS. 8 through 12 illustrate a preferred embodiment of the end mounting means 16 for connecting of the sun shade member 18 to the arm 14. Arm 14 has two spaced apart parallel bars 66 connected to one another by means of a loop 68. Preferably, the bars 66 of the arm 14 are connected to one another at both ends of the arm 14 by loops 68. This arrangement of the arms as two spaced apart bars 66 connected to one another at opposite ends provides torsional stiffness to the arm and enables the arm to be constructed of relatively light bar stock compared to some of the prior arrangements described in the background above. The arm 14 may also be provided as a single bar having an elongate loop at the forward end thereof for attachment to the end mounting arrangement. While this structure would not be as torsionally stable as the preferred embodiment, it would allow increased adjustability of the positioning of the sun shade relative to the clamping means.

The end mounting arrangement 16 has a base member 70 generally elongate in shape having on the side on which the arm will be mounted a circular extension 72 having an outside diameter approximately equal to the space between the parallel spaced apart bars 66 of the arm 14. The circular extension 72 is provided with an extending tab 74 to which an elliptical friction fit member 76 is mounted by sliding a slot 78 provided in the elliptical friction fit member 76 over the tab 74. The elliptical friction fit member 76 is secured to the base 70 by means of a rivet 80. The elliptical friction fit member 76 has a short dimension approximately equal to that of the spacing between the spaced apart bars 66 and a long dimension greater than that of the outside of the spaced apart bars 66. The arm 14 is attached to the end mounting arrangement 16 by inserting the spaced apart bars 66 past the exterior of the elliptical friction fit member 76 as shown in dashed outline in FIG. 8 and then bringing the loop 68 into engagement with circular extension 72 of the base 70 and rotating the arm until the spaced apart bars 66 are entrapped within the space defined by the longer dimensioned exterior portion of the friction fit member 76 and the base 70. The base 70 of end mounting arrangement 16 may also be provided with a stop 82 at its top for engaging the loop 68 of the arm 14 when it is held by the friction fit member 76. The arm 14 may be attached to the end mounting arrangement 16 so that the clamping means 12 may be on either side of the arm relative to the sun shade member 18. Thus, the clamping means 12 may be on the same side of the arm 14 as the sun shade member 18 as shown in FIG. 1 or it may be on the opposite side.

End mounting arrangement 16 is also provided with means for supporting the sun shade member 18. Preferably the sun shade member 18 is provided by a canopy 84 supported by a wire frame having two U-shaped members 86 which are attached to one another at their ends thereof. The canopy 84 is held on the wire frame members 86 by having pockets on either side through which the frame members 86 are located. In some circumstances, it may be desired to provide a small pocket on the underside of the canopy for holding of small objects such as sunglasses, wallets, etc. Such pocket may be provided with an elasticated opening or a closure means for the opening to retain the object within the pocket when the sunshade is dismantled for transport or storage. One end of each of the U-shaped wire frame members 86 is attached to the end mounting arrangement 16. The side of the base 70 of the end mounting arrangement 16 for holding the sun shade member 18 is provided with extending tabs 88 at one end thereof for containing and holding one portion of the frame members 86 of the sun shade member 18. The other end of the base is also provided with an upper tab 90 and a lower engaging member 92 which allows for releasable engagement of the frame 86 of the sun shade member 18. Lower engaging member 92 is provided with a camming surface 94 on which the frame of the sun shade member 18 may ride and thereafter be contained within the spacing between the upper tab 90 and lower engaging member 92. When it is desired to dismantle the sun shade member 18, the frame 86 may be disengaged by pulling the frame 86 from the spacing away from the upper tab 90 and allowing the frame to ride over the camming surface 94 on the lower engaging member 92.

The U-shaped wire frame members 86 are attached to the end mounting arrangement 16 by wrapping the ends of the U-shaped members 86 to form loops 96 which surround a boss (not shown) provided on the base 70 through which the shaft of the rivet 80 for holding the end mounting arrangement 16 together passes. The end mounting arrangement 16 is held together by means of the rivet 80 and a washer 98 spaced the proper distance from the base 70 by the boss. The opposite ends of the U-shaped wire frame members 86 are attached to one another by looping the ends 100 about an attachment means 102 suitable for connecting the frame members 86 together. One such attachment means 102 is a plastic attaching member such as a push-in fastener which is used with a plastic washer of appropriate diameter. The push-in fastener has a shaft comprising generally semicircular legs separated by a slot. Each of the legs is provided with seating surfaces which engage the washer and maintain the connection. Such a fastener enables easy disassembly of the canopy 84 from the frame 86, as the washer may be easily removed from the push-in fastener by squeezing the legs of the fastener together and disengaging the fastener from the washer. In this way the canopy 84 may be removed for cleaning or may be replaced by another canopy for fashion or advertising and promotion reasons.

FIGS. 13 through 15 illustrate preferred means of attaching the clamping means 12 to the arm 14 to provide for adjustability of the clamping means 12 and the arm 14. The means of attachment of the clamping means 12 to the arm 14 allows for both up and down adjustment of the clamping means 12 as well as for the rotation of the clamping means 12 to adjust for the angle of the arm 14 in relation to the supporting surface to which the clamping means 12 is attached. This permits a wide range of adjustment of the sun shade 10 to provide for optimum shading of the sun. A first means of such attachment is shown in FIG. 13 where the clamping means 12 is provided with a threaded extension 104. Complementary holding members 106 are provided having a circular opening 108 through which the threaded extension 104 may pass and further biasing spaced apart grooves 110 for holding the spaced apart bars 66 of the arm 14. A threaded adjusting screw 112 is provided which engages the thread of the threaded extension 104 of the clamping member 12. A washer 114 is provided such that when the threaded screw 112 is tightened down, the holding members 106 are securely held between the washer 114 and a holding surface 116 provided on the clamping means 12. This arrangement securely holds the spaced apart bars 66 of the arm 14 within the grooves 110. The adjustment means illustrated in FIG. 13 allows for adjustment both of the clamping means 12 up and down along the arm 14 as well as for rotation of the arm 14 in relation to the clamping means 12. By means of this arrangement, the sun shade 10 may be easily adjusted for attachment to a surface at any angle to provide for maximum protection from the sun.

FIG. 14 illustrates a second means of attaching the clamping means to the arm 14. Clamping means 12 is provided with a threaded extension 104 and holding members 106 are provided having the openings 108 and the grooves 110 as described above. A threaded screw 118 and washer 114 provide for attachment of the holding member 106 to the clamping device 12.

Holding surface 120 on the clamping means 12 is provided with radially extending serrated engagement means 122. A second holding surface 124 shown in FIG. 15 is provided on one of the mounting blocks having complementary radially extending toothed engagement means such that when the screw 118 is tightened into the threaded extension 104, the radially extending serration means on the holding surfaces 120 and 124 meet and securely hold the arm 66 within the grooves 110 of the mounting blocks 106.

A biasing means may be provided to allow the adjustment of the angle between the arm 14 and the clamping means 12 by rotating the arm 12 and mounting blocks 106 such that the toothed serrations on the holding surfaces 120 and 124 ride up and separate against the biasing until the desired angle is achieved and the biasing thereafter holds the toothed serrations in mating relationship. Alternatively, owing to the lightweight of the sun shade arrangement as described herein, a separate biasing means may not be required as the plastic material from which the mounting blocks 106 are constructed may have enough flexibility to permit the toothed serration members to be rotated to adjust for the desired angle between the arm and the mounting block.

The sun shade of the present invention provides for numerous benefits to the user. It is very light in weight and due to its construction, in particular the provision of the collapsibility of the sun shade arrangement and the ease of assembly and disassembly, it is easily packaged and transportable. This enables the sun shade to be easily carried by the user to any location and may be easily packed in the luggage of a vacationing user. The structure of the sun shade and its adjustability permits the sun shade to be smaller as only one relatively light and compact arm is required to support the sunshade. This adjustability provided in particular by the clamping means and the means of attachment of the clamping means to the arm as well as the end mounting piece for attachment of the sun shade member to the arm allows the sunshade of the present invention to adjusts to almost any position of the sun relative to the position of the user.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A sun shade arrangement for releasable attachment to outdoor furniture, said arrangement comprising a reusable clamping means, an arm having a forward end and a sun shade member having a mounting end piece secured to the forward end of the arm, the arm comprising spaced apart bars removably and adjustably secured to the clamping means and the spaced apart bars being connected to one another at the forward end of the arm and providing a releasable connection for the mounting end piece of the sun shade member.

2. A sun shade arrangement as claimed in claim 1 wherein the clamping means comprises a first clamping member having an upper clamping region, and a second clamping member having a lower clamping region defining a clamping space provided between the upper clamping region and lower clamping region.

3. A sun shade arrangement as claimed in claim 2 wherein the clamping means further comprises a lower screw holding region and a side region connecting the upper clamping region to the lower screw holding region.

4. A sun shade arrangement as claimed in claim 3 wherein the second clamping member has an extending arm having an engagement member which rides in an adjustment slot provided in the side region connecting the upper clamping region to the lower screw holding region.

5. A sun shade arrangement as claimed in claim 4 wherein the clamping means is provided with an adjusting screw having a turning knob at one end thereof, the shank of the adjusting screw being contained in a threaded hole provided in the lower screw holding region, a second end of the adjusting screw being in contact with the second clamping member such that as the adjusting screw is turned, it adjusts the clamping space provided between the upper clamping region and lower clamping region.

6. A sun shade arrangement as claimed in claim 5 wherein the upper clamping region is provided with flat clamping surfaces located on either side of an arched clamping surface, and the lower clamping region is provided with flat clamping surfaces on either side of an arched clamping surface.

7. A sun shade arrangement as claimed in claim 1 wherein the arm comprises spaced apart bars connected to one another at either end thereof by loops.

8. A sun shade arrangement as claimed in claim 7 wherein the end mounting arrangement comprises a base member having on the side on which the arm will be mounted an elliptical friction fit member having a short dimension approximately equal to that of the spacing between the spaced apart bars of the arm and a long dimension greater than that of the outside of the spaced apart bars, the friction fit member being spaced from the base for engagement of the arms therebetween.

9. A sun shade arrangement as claimed in claim 8 wherein the end mounting arrangement further includes a stop for engaging the forward end of the arm when it is held by the friction fit member.

10. A sun shade arrangement as claimed in claim 9 wherein the releasable connection for the mounting end piece of the sun shade member comprises extending tabs at one end thereof for containing and holding one portion of the frame of the sun shade member, an upper tab and a lower engaging member provided at the other end thereof to allow for releasable engagement of the frame of the sun shade member.

11. A sun shade arrangement as claimed in claim 10 wherein the lower engaging member is provided with a camming surface on which the frame of the sun shade member may ride and thereafter be contained within the spacing between the upper tab and lower engaging member.

12. A sun shade arrangement as claimed in claim 11 wherein the sun shade member is provided by a canopy held on the wire frame by pockets on either side through which the frame members are located.

13. A sun shade arrangement as claimed in claim 12 wherein the sun shade member further includes a pocket on the underside of the canopy for holding of small objects.

14. A sun shade arrangement as claimed in claim 13 wherein the pocket on the underside of the sun shade member is provided with an elasticated opening or a closure means for the opening to retain the object within the pocket.

15. A sun shade arrangement as claimed in claim 1 wherein the arms are adjustably secured to the clamping means by being held between complementary holding members releasably held between a securing means and a holding surface provided on the clamping means.

16. A sun shade arrangement as claimed in claim 15 wherein the holding surface on the clamping means is provided with radially extending serrated engagement means and a second holding surface is provided on one of the mounting blocks having complementary radially extending serrated engagement means such that the radially extending serrated engagement means on the holding surfaces meet for limiting rotation of the complementary holding members.

* * * * *